US005901646A

United States Patent [19]

Walker et al.

[11] Patent Number: 5,901,646

[45] Date of Patent: May 11, 1999

[54] SCREEN PRINTING MACHINE HAVING THREE AXES SCREEN REGISTRATION WITH SHIFTABLE SUPPORT VACUUM TABLE FOR WEB

[75] Inventors: Christopher S. Walker, Overland Park, Kans.; Ivan B. Helmrich, Kansas City, Mo.

[73] Assignee: Preco Industries, Inc., Lenexa, Kans.

[21] Appl. No.: 08/955,274

[22] Filed: Oct. 21, 1997

[51] Int. Cl.[6] ..... B05C 17/04

[52] U.S. Cl. ..... 101/123; 101/126; 101/486; 33/614; 33/621

[58] Field of Search ..... 101/114, 123, 101/124, 126, 129, DIG. 36, 481, 485, 486; 33/614, 617, 621

[56] References Cited

U.S. PATENT DOCUMENTS

| | | | |
|---|---|---|---|
| 5,050,496 | 9/1991 | Klemm | 101/123 |
| 5,176,078 | 1/1993 | Homma | 101/126 |
| 5,241,187 | 8/1993 | Ikeda et al. | 101/114 |
| 5,459,941 | 10/1995 | Lowe | 101/481 |

*Primary Examiner*—Ren Yan

*Attorney, Agent, or Firm*—Hovey, Williams, Timmons & Collins

[57] ABSTRACT

A high speed screen printing machine (20) is provided for accurately imprinting images on segments (205) bearing indicia (206) of a transparent web (34, 36). The machine (20) includes a vacuum platen (24) which is transversely adjustable to accommodate webs of differing widths, a camera assembly (28) beneath the platen (24) and indicia (206), and an X, Y, θ adjustable frame (30) supporting an upper screen frame support assembly (32) adapted to hold a printing screen (208) provided with reference indicia (212). When a segment (205) is initially positioned and held by platen (24), the camera assembly (28) is used to generate a combined image of the indicia (206) through the segment (205) and the screen reference indicia (212); a microprocessor controller uses this data, together with positional information establishing the location of the screen frame support assembly (32), and activates the three-motor adjustment frame (30) for simultaneous X, Y and θ adjustment of the support assembly (32) and camera assembly (28) until the screen (208) and segment (205) are registered. At this point, a squeegee is used to transfer the screen image onto the segment (205).

11 Claims, 7 Drawing Sheets

SCREEN PRINTING MACHINE HAVING THREE AXES SCREEN REGISTRATION WITH SHIFTABLE SUPPORT VACUUM TABLE FOR WEB

BACKGROUND OF THE INVENTION

1. Field of the Invention

The present invention is concerned with an improved, high speed screen printing machine which permits extremely accurate imprinting of successively fed planar segments. More particularly, the invention pertains to such a screen printing machine, and corresponding methods, wherein a camera is located adjacent the bottom face of the segment to be imprinted and is oriented to view a marginal segment indicium through the segment material while simultaneously viewing a reference indicium carried on the screen; this combined image data is then used to adjust the screen, preferably by simultaneously moving the screen along two transverse adjustment axes parallel to the plane of the segment, and about a rotational axis transverse to such plane.

2. Description of the Prior Art

It is known to provide a screen printing press for printing on a web having defined areas or segments that are successively brought into a position to be printed. The press includes a flat, image-bearing screen supported on the base of the press for movement between a printing position overlying the web and an interrupted position spaced from the web. In addition, a web handling assembly is provided for advancing the web along a path of travel to successively feed the defined segments toward a work station defined by the press base.

When the web is to undergo multiple printing processes, e.g. in the production of multi-color images, it is necessary to print each individual color on the web and to dry the web prior to printing the subsequent color. Therefore, as the web is fed to the work station for the second and all subsequent printing operations, it is necessary to register each successive image, or defined segment, with the screen so that all of the colors are in register with one another. Typically, such registration is achieved manually by adjusting the position of the screen on the press and printing proof images on the web until registration is obtained. Thereafter, it is assumed that the web and screen remain in register as each successive area of the web is fed a predetermined distance to the work station by the web handling system. If misregistration occurs due to stretching or contraction of the web material, the press is stopped and the screen position is readjusted to properly register with the web. Alternately, it is possible to manually adjust the incremental feed of the web to compensate for such misregistration.

It is also known in the screen printing art that the centerline of the image to be imprinted should be located in registry with the centerline of the web for optimum printing results. If only a single web width is employed, such centerline matching does not present any significant problems. However, where a given screen printing machine is designed to handle webs of varying widths, a problem arises in that it is difficult to rapidly and accurately realign the machine for varying web widths while still maintaining centerline printing.

Pending application for U.S. patent Ser. No. 08/658,025 describes a screen printing press having longitudinal, lateral, and angular screen frame registration. In the described press, longitudinal adjusting means is provided for precise longitudinal alignment between the screen and web along the X axis (i.e., along the path of web travel). A separate adjusting mechanism is used for lateral (Y axis) and angular (θ axis) adjustments between the screen and web. Accordingly, the press of the '025 application is incapable of simultaneous X, Y, θ adjustments.

Pending application for U.S. patent Ser. No. 08/825,368 describes a web processing apparatus such as a die cutting machine which includes a unique three-motor adjustment mechanism permitting simultaneous X, Y, θ adjustment of a segment-holding platen. Both of the aforementioned U.S. patent applications are incorporated by reference herein.

SUMMARY OF THE INVENTION

The present invention provides a greatly improved screen printing machine which is adapted for imprinting substantially planar segments at high speed and with extremely accurate registration. Broadly speaking, in one aspect the invention provides a machine for imprinting a planar segment including a light-transmitting, indicium-bearing portion thereon (preferably the entire segment is transparent or at least translucent) and including a platen presenting a segment-engaging face and an opposed face, with a screen-supporting assembly adjacent the segment-engaging face of the platen adapted to carry a printing screen bearing an image to be imprinted upon the segment. The camera is located adjacent the opposed face of the platen and is oriented for viewing the segment indicium through the light-transmitting portion of the segment. An adjuster is operably coupled with the camera via a microprocessor controller for selectively adjusting the screen-supporting assembly in response to the position of the segment indicium as viewed by the camera.

In preferred forms, a continuous transparent web is imprinted, and successive segments thereof are shifted into the printing machine. The machine is particularly suited for imprinting successive images onto respective segments with high registration precision (within at least about 0.004 inches and more preferably within at least about 0.001 inches). In such instances, it is preferred that the screen also bear a reference indicium thereon, with the camera located for viewing the reference indicium simultaneously with the segment indicium. To this end, the preferred platen includes a relieved area or zone adjacent a margin thereon for exposing an edge of the segment where the segment indicium is located, and the camera is disposed to simultaneously view the segment indicium through the transparent web material and the reference indicium on the screen. Normally, the platen, screen and web segments are substantially horizontal, and the camera is disposed below the platen and segments.

In another aspect of the invention, the screen-supporting assembly is adjustable along two transverse adjustment axes parallel to the plane of the segment, and also about a rotational axis transverse to this plane, in response to camera image data establishing the position of the segment indicium relative to a reference indicium (which may be on the screen or any other relative position). In especially preferred forms, the adjuster includes a three-motor assembly for simultaneous movement of the screen-supporting assembly along the two transverse adjustment axes and about the rotational axis. The camera assembly is also adjustable, and preferably is mounted for X, Y and θ adjusting movement in unison with the screen-supporting assembly.

In order to accommodate webs of varying widths while retaining the desirable centerline printing, the machine of the invention includes a segment supporting platen which is shiftable in a direction transverse to the direction of the segments to be imprinted, so that the platen centerline can be moved to register with the centerline of the segments. Additionally, the cameras are initially adjustable along the X and Y axes so that the camera can be located adjacent the web edge, irrespective of web width.

DETAILED DESCRIPTION OF THE PREFERRED EMBODIMENT

Figure 1:
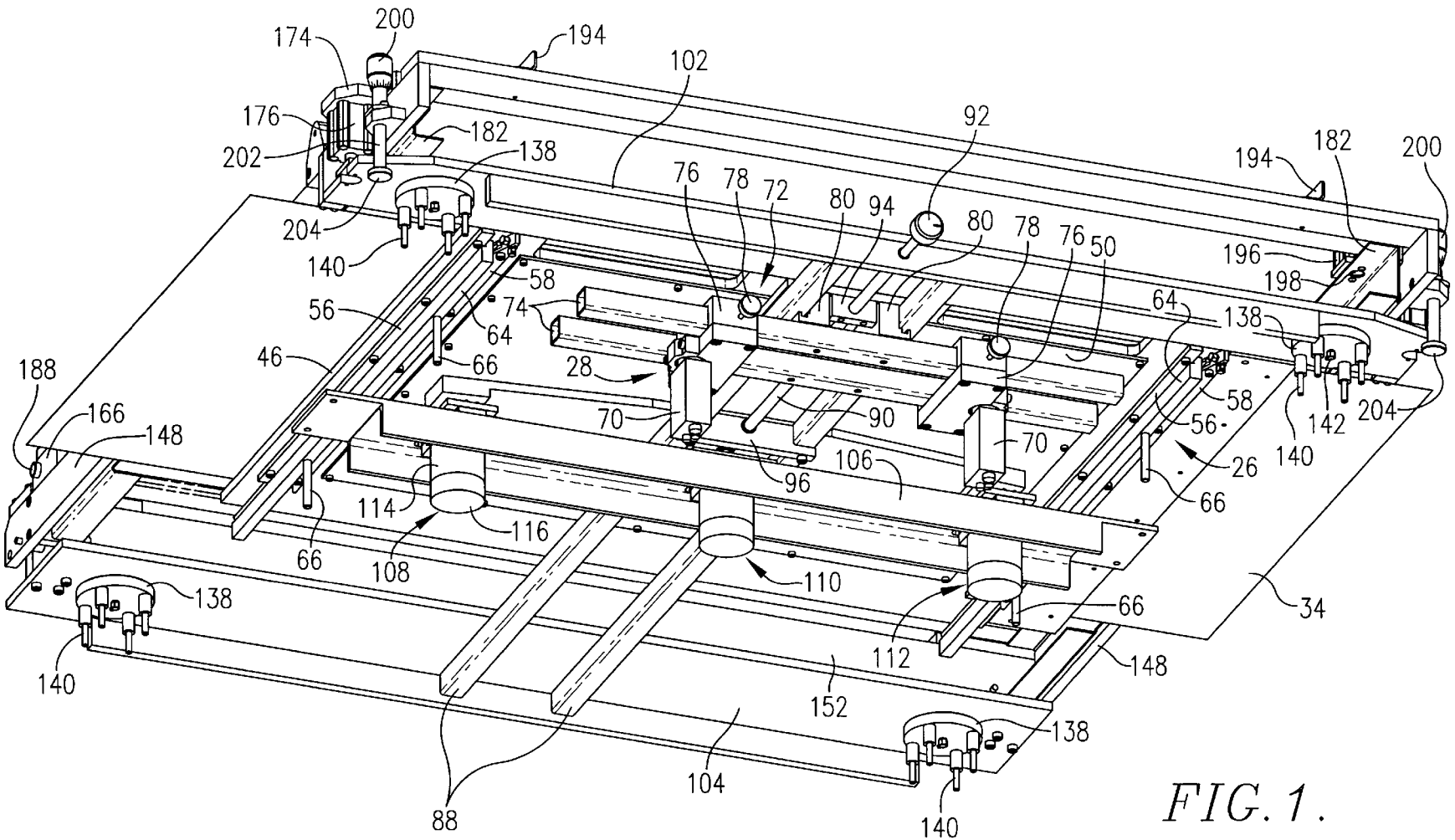
FIG. 1 is a bottom isometric view illustrating the platen, platen adjustment assembly, camera assembly, and X, Y, θ adjustable frame of the screen printing device of the invention.

Turning now to the drawings, and particularly FIGS. 1–4, a screen printing machine or device 20 in accordance with the invention is illustrated. Broadly speaking, the device 20 includes a rigid machine base assembly 22, a vacuum platen 24, a Y-axis platen adjustment assembly 26, a camera assembly 28, an X, Y, θ adjustable frame 30, and a screen frame support assembly 32. As will be evident from the following discussion, the device 20 is designed to receive and accurately imprint segments of continuous webs 34 (FIG. 2) and 36 (FIG. 3) of varying widths.

In detail, the machine base assembly 22 is in the form of a rigid, upright unit with legs 38 and a pair of spaced apart, fore and aft transverse rail tubes 40. The assembly 22 presents an operator side 42 and a drive side 44 for the device 20.

Figure 8:
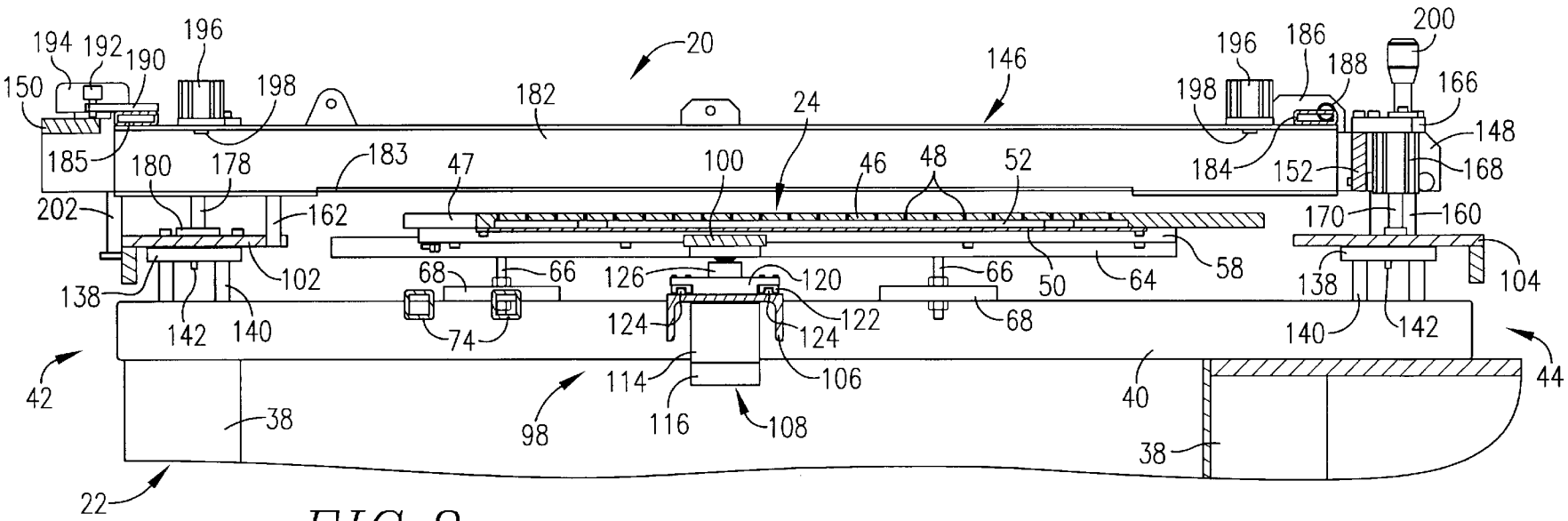
FIG. 8 is a vertical sectional view taken along line 8—8 of FIG. 3.
Figure 7:
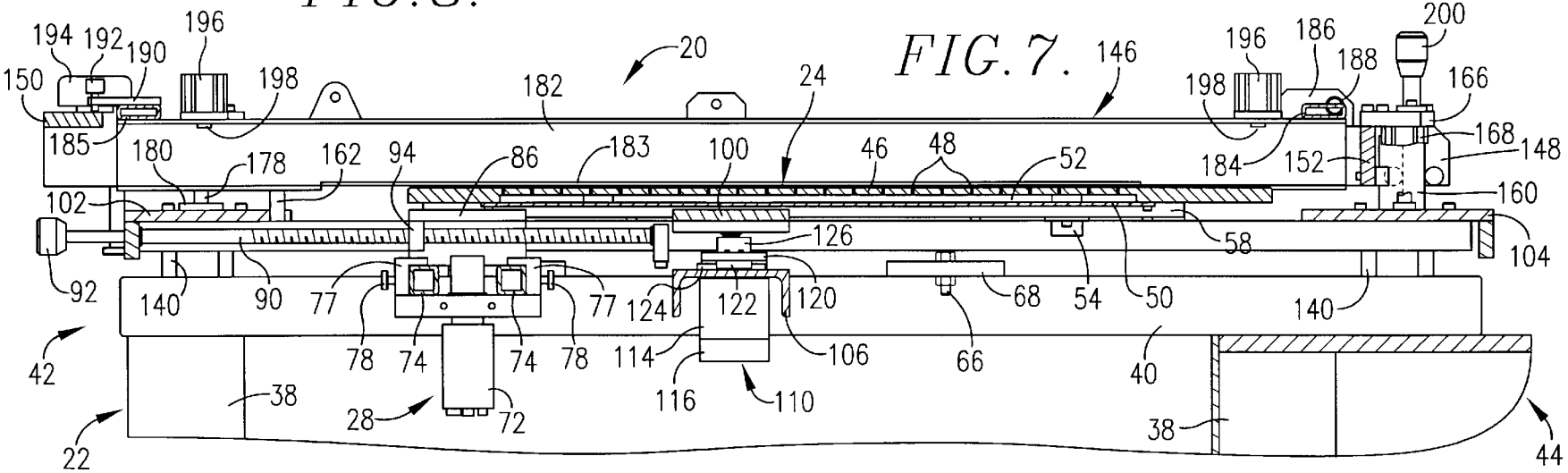
FIG. 7 is a vertical sectional view taken along line 7—7 of FIG. 3.

The platen 24 is of generally rectangular plan configuration and presents an uppermost web-supporting plate 46 provided with a large number of vacuum apertures 48 therethrough as well as a pair of spaced apart, somewhat rectangular cutout areas 47. A lower closure plate 50 is secured to plate 46 as best seen in FIGS. 7–8, and the two plates 46, 50 cooperatively define a plenum 52 therebetween. The platen 24 is in use operatively coupled with a vacuum source through a centrally disposed port fitting 54 (FIG. 7).

Figure 9:
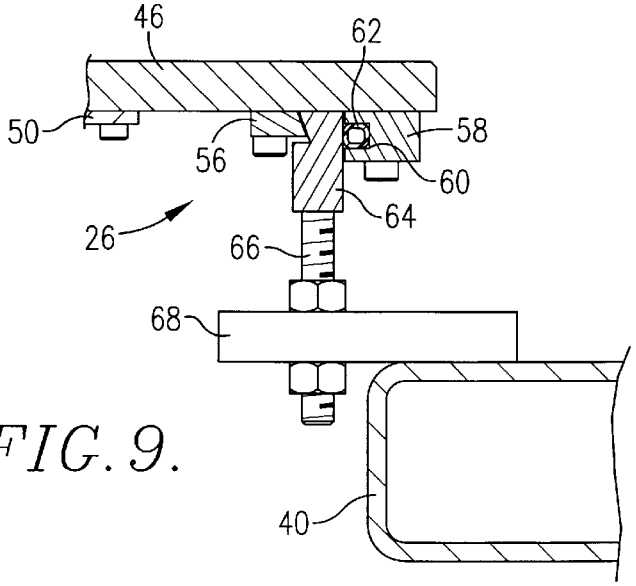
FIG. 9 is an enlarged, fragmentary vertical sectional view depicting the details of the preferred platen adjustment assembly.

The platen 24 is supported for Y axis (i.e., transverse to the path of travel of the continuous web through the device 20) adjustment by means of the assembly 26. This includes a pair of elongated dovetail blocks 56 respectively secured to the underside of plate 46 and extending transversely along the fore and aft margins thereof. In addition, the assembly 26 includes a pair of elongated backing blocks 58 which are respectively adjacent to and spaced from a corresponding dovetail block 56. As best seen in FIG. 9, each backing block 58 has an elongated, substantially square recess 60 formed in the depending face thereof adjacent the proximal dovetail block 56; an elongated, radially expandable, resilient pneumatic locking tube 62 is located within each recess 60. The overall platen adjustment assembly 26 further includes a pair of upright, elongated, frame-supported mating dovetail blocks 64 disposed between each adjacent pair of dovetail and backing blocks 56, 58, respectively. As best seen in FIG. 9, the mating block 64 is relieved to mate with block 56, with the opposite face thereof abutting the face of backing block 58. A pair of spaced apart, depending threaded shafts 66 extend from each block 64 and are rigidly connected to lateral tab members 68; the tab members 68 are in turn welded to the adjacent rail tube 40 forming a part of the machine base assembly 22. In order to assist in the accurate Y axis placement of the platen 24, a scale 69 is secured to the righthand rail tube 40 as viewed in FIG. 2. The scale 69 includes a centerline tick 69*a* as well as scale markings 69*b*.

Camera assembly 28 is mounted beneath the platen 24 and includes a pair of spaced apart CCD cameras 70 each supported on a carriage unit 72. The carriage unit 72 includes a pair of laterally spaced apart, fore and aft extending support tubes 74 which cooperatively carry two camera mounts 76, each of the latter supporting one of the cameras 70 (see FIG. 1). Each camera mount 76 has a pair of inverted, generally L-shaped slide blocks 77 respectively shiftable along the length of a corresponding tube 74. The blocks 77 are clamped in place by a clamping screws 78 which bear against the tubes 74. Thus the cameras 70 may be adjustably positioned along the lengths of the tubes 74.

Figure 10:
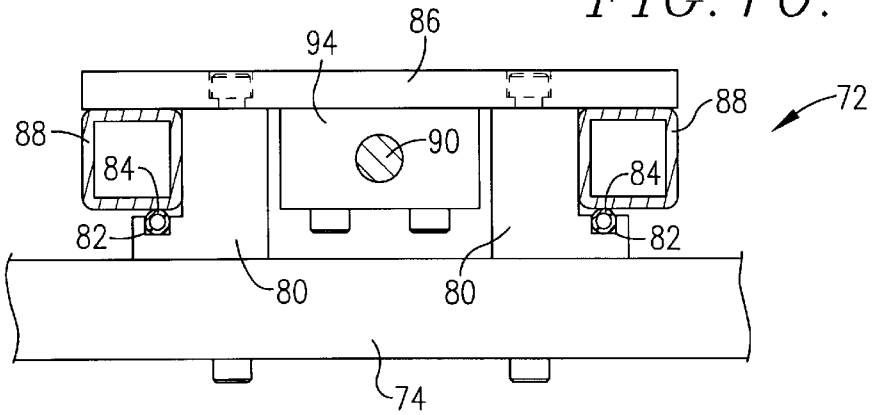
FIG. 10 is a fragmentary vertical sectional view illustrating the carriage unit forming a part of the camera assembly.

The carriage unit 72 further includes a pair of upstanding, generally L-shaped mounting blocks 80 (see FIG. 10) which are affixed to the tubes 74. Each block 80 has a recess 82 formed in the transverse leg thereof, with each recess 82 receiving an inflatable resilient locking tube 84. An elongated top plate 86 is secured to the upper surfaces of the blocks 80. The blocks 80 and top plate 86 are designed to slidably receive transversely extending tubes 88 forming a part of the X, Y, θ adjustable frame assembly 30. The camera assembly 28 is selectively shiftable along the length of the tubes 88 (i.e., transverse to the path of web travel) through the medium of thrust screw 90 having an outermost knob 92 at operator side 42. The thrust screw 90 extends through a threaded block 94 secured to and depending from top plate 86, with the inner end of the thrust screw engaging stop block 96 secured to the tubes 88.

The X, Y, θ adjustment frame 30 includes a three-motor motive assembly 98 located below platen 24, an elongated operator 100, the aforementioned tubes 88, and operator side and drive side frame plates 102, 104.

Figure 6:
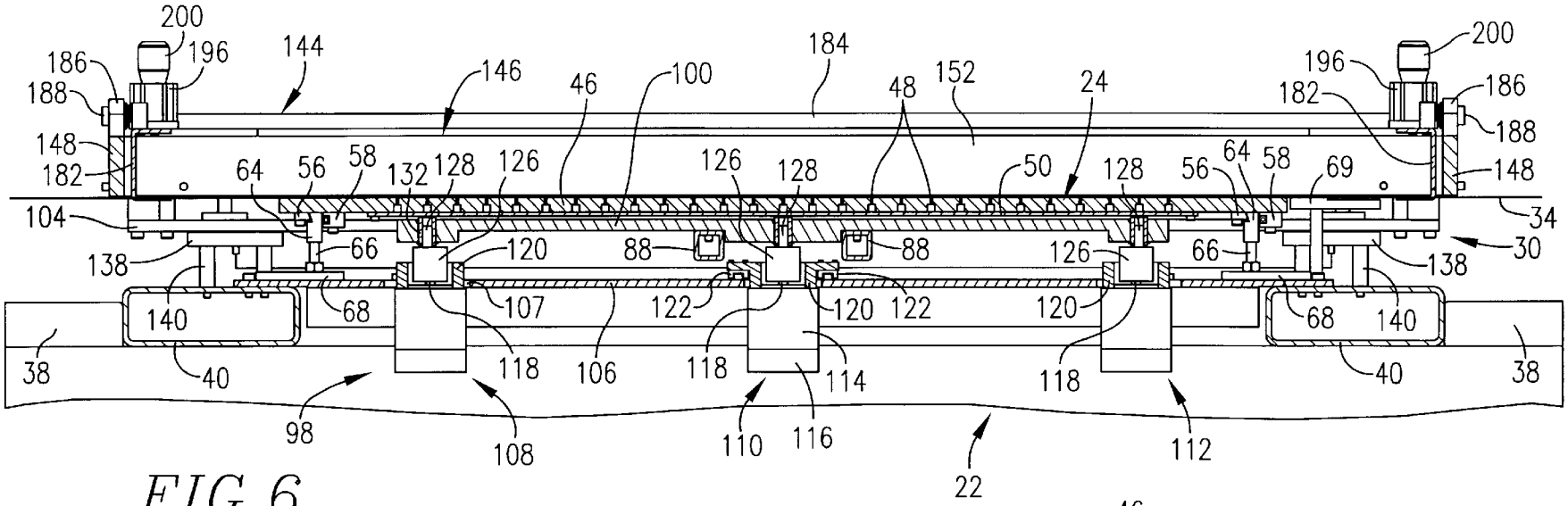
FIG. 6 is a vertical sectional view depicting the construction of the platen and the preferred three-motor X, Y, θ motive assembly forming a part of the X, Y, θ adjustable frame.

The motive assembly 98 has an elongated, fore and aft extending, apertured channel 106 which is secured to and extends between the rail tubes 40. Three stepper motor units 108, 110, 112 are supported by channel 106 and are disposed within respective rectangular channel openings 107. Each of the units 108, 110, 112 includes an electrically powered bidirectional stepper motor 114 equipped with an encoder 116; each stepper motor 114 also has an upright, rotatable output shaft 118 (FIG. 6). Each motor 114 is further equipped with a slide carriage 120 adjacent the upper end thereof which supports a pair of elongated yoke bearings 122. Three separate pairs of mounting rails 124 are respectively located on channel 106 astride each of the channel openings 107 and receive the yoke bearings of the corresponding motor slide carriages. As best illustrated in FIG. 6, the central stepper motor unit 110 is mounted for translational movement thereof in the Y direction, that is transverse to the path of web travel through device 20. On the other hand, the outboard motor units 108 and 112 are each mounted for translational movement in the X direction, or parallel to web travel.

The output shafts 118 of each of the stepper motors 114 are provided with an upstanding eccentric block 126 having an upper pivot pin 128 oriented in offset relationship relative to the output shaft 118. The elongated operator element 100 is disposed above the stepper motor units 108–112, and is coupled thereto through the medium of bearings 132 provided in the underside of the element 100.

Figure 5:
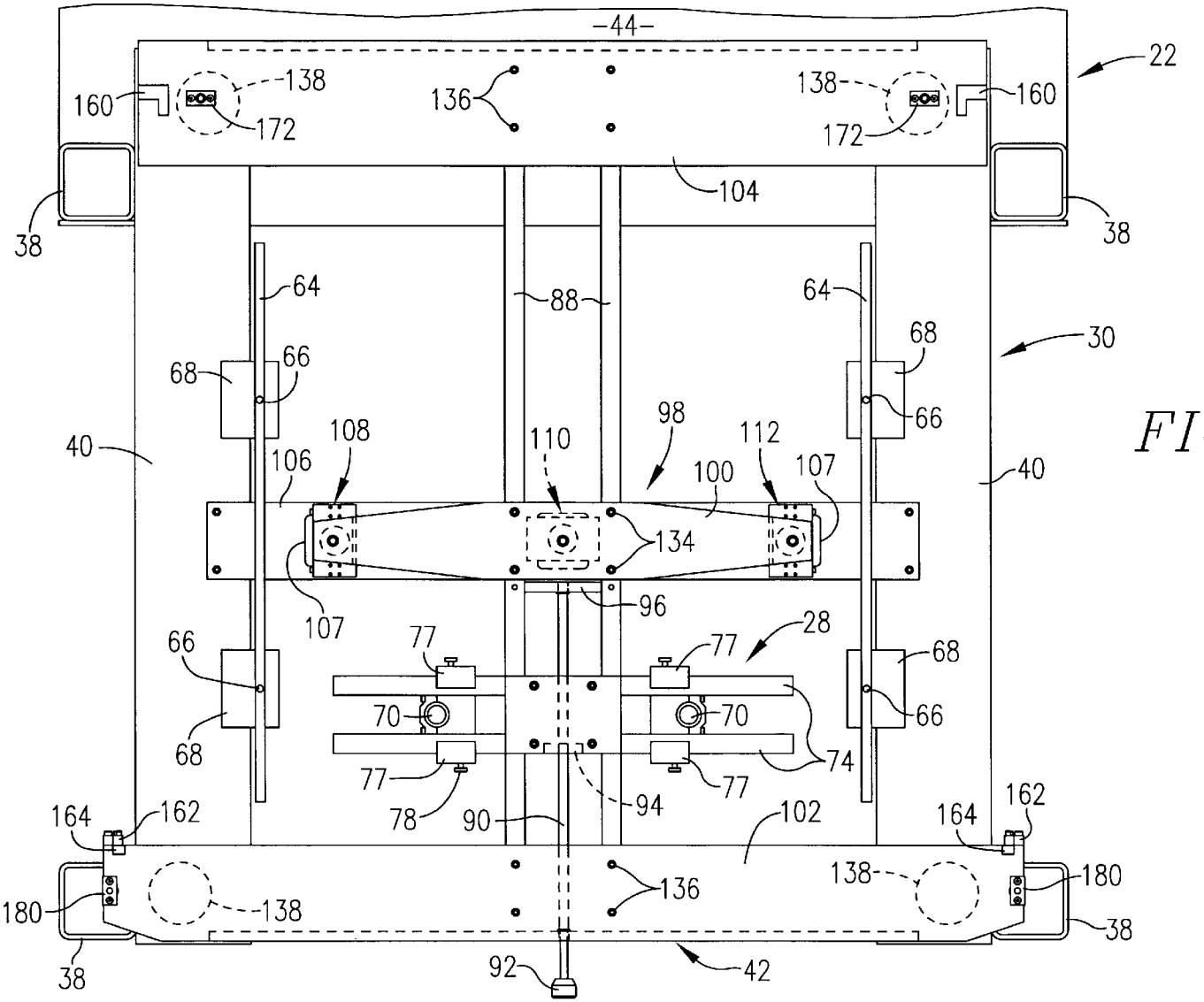
FIG. 5 is a plan view illustrating the construction of the X, Y, θ adjustable frame and the camera assembly of the screen printing device.

The tubes 88 are secured to the underside of operator 100 by means of fasteners 134. The frame plates 102 and 104 are also rigidly secured to the tubes 88 via fasteners 136 adjacent the operator side and drive side ends thereof FIG. 5. Thus, the operator 100, tubes 88 and frame plates 102, 104 move in unison, as dictated by the operation of the respective stepper motor units 108–112.

Figure 2:
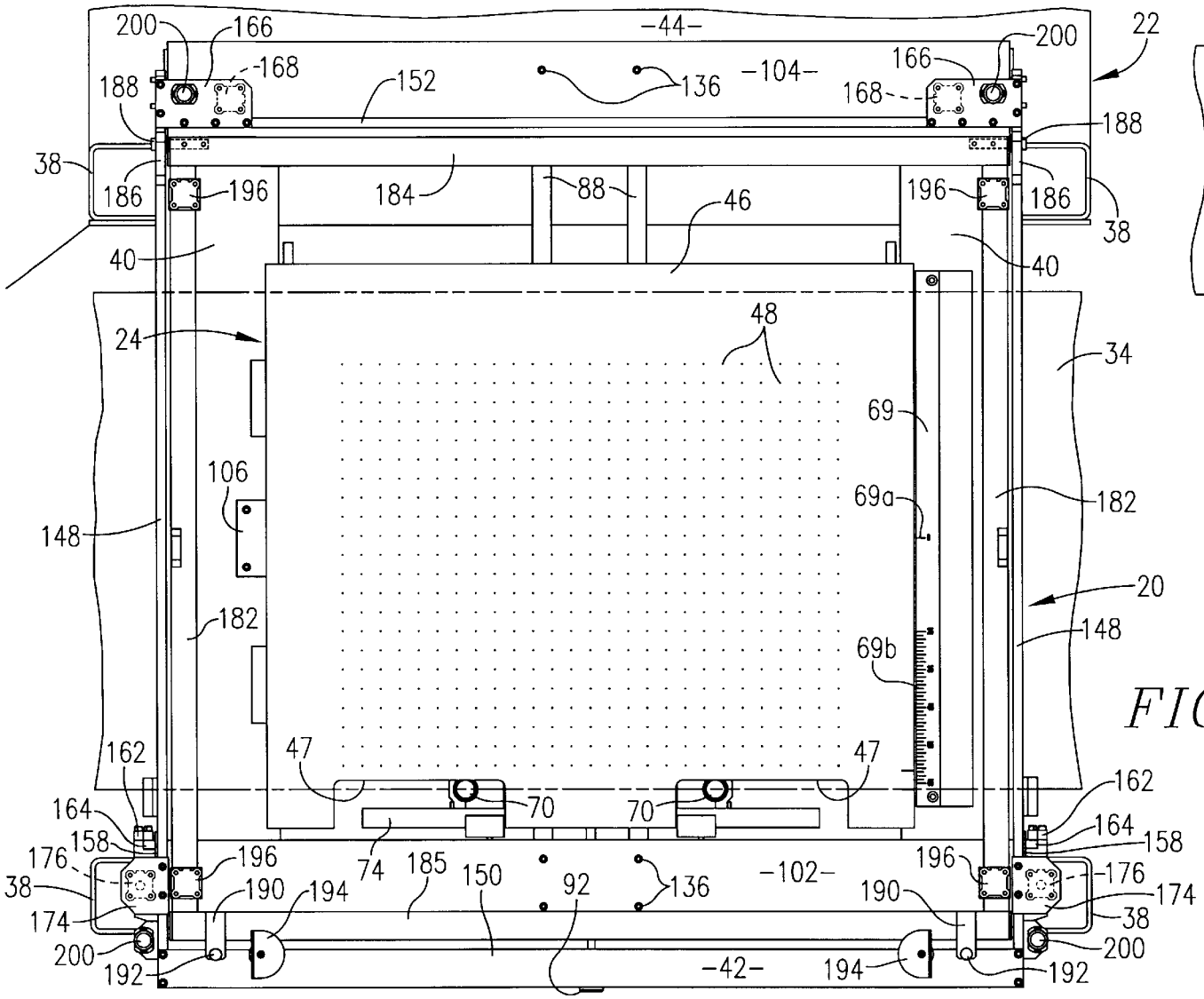
FIG. 2 is a plan view of the screen printing device configured for receiving and imprinting a relatively wide, continuous web.
Figure 3:
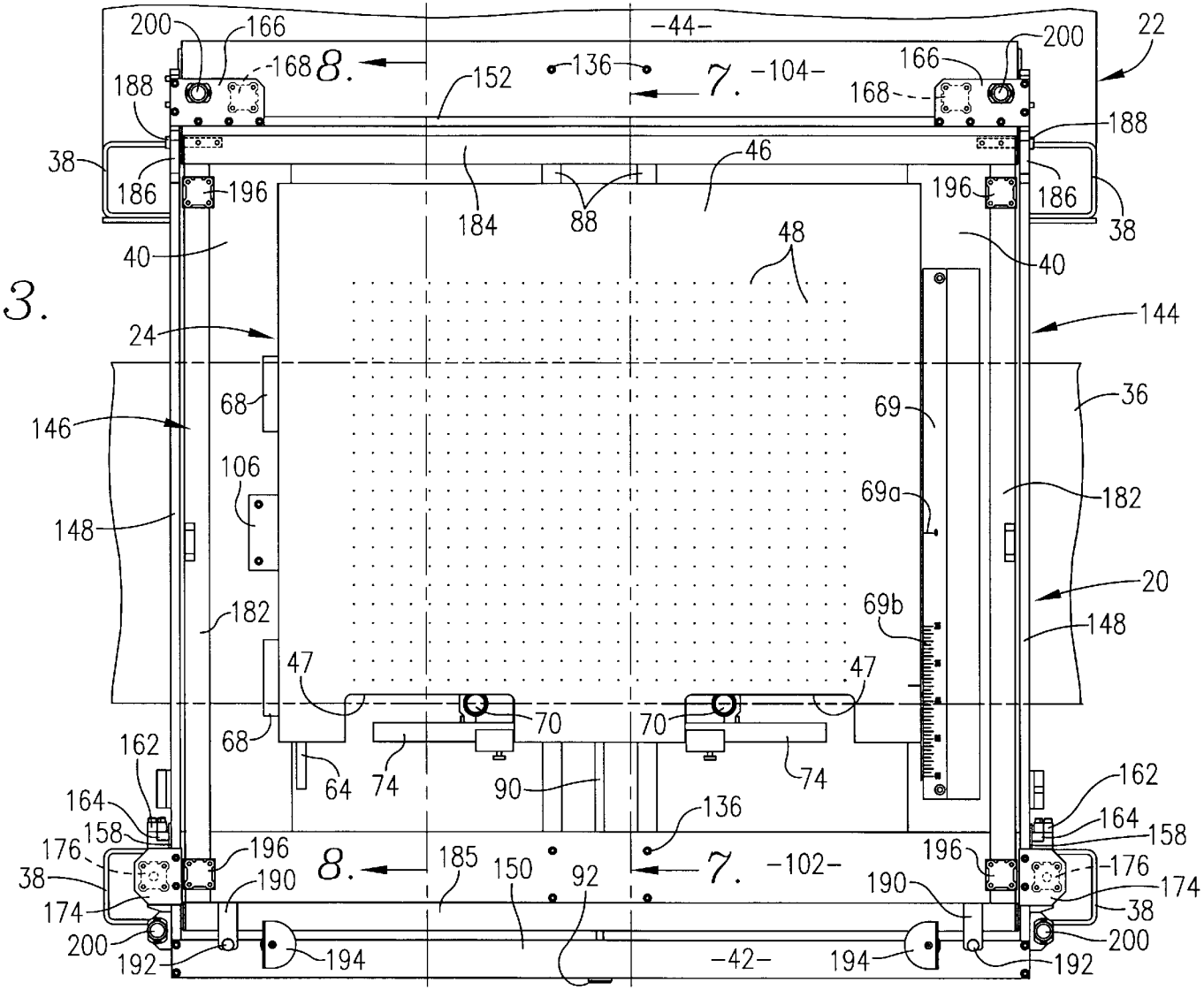
FIG. 3 is a plan view similar to that of FIG. 2, but depicting the screen printing device configured for receiving and imprinting a relatively narrow, continuous web.
Figure 4:
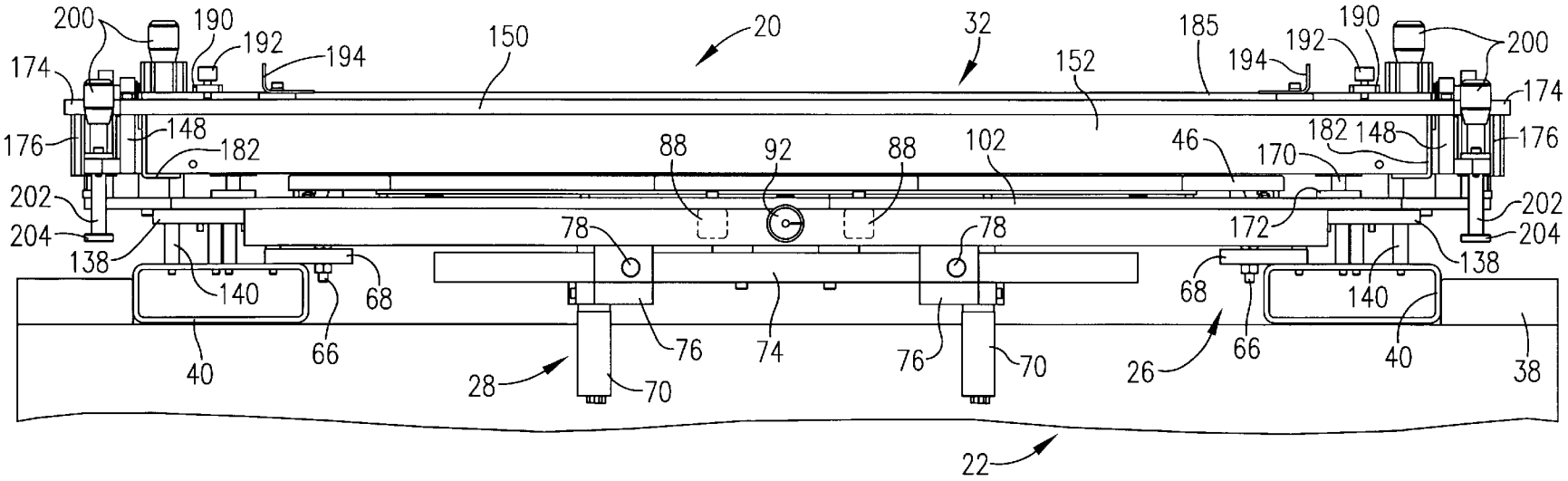
FIG. 4 is a fragmentary side view of the operator side of the screen printing device of the invention.

The opposed ends of the operator side and drive side frame plates 102, 104 are spaced apart a distance substantially greater than the transverse width of platen as seen in FIGS. 2 and 3. This is important in allowing the device 20 to accommodate different web widths while retaining centerline printing thereof as will be explained. The plates 102, 104 are supported on four corner mounted air bearings 138. Each air bearing 138 has four depending connection bolts 140 which are secured to the underlying rail tube 40. Each air bearing unit 138 also includes a nipple 142 for supply of pressurized air thereto. Thus, the frame plates 102, 104, the tubes 88 and camera assembly 28, and operator 100, are all supported by the air bearings 138.

The operation of X, Y, θ adjustment frame 30 is controlled by means of a microprocessor controller (not shown) operatively connected to the encoders 116, the stepper motors 114, air bearings 138 and the cameras 70. The controllers is capable of activating the air bearings receiving input data from the cameras 70 and encoders 116, performing an algorithm discussed hereafter, and energizing the stepper motors 114.

The screen frame support assembly 32 is mounted on the X, Y, θ adjustment frame 30 for movement in unison. In particular, the assembly 32 includes an outer main frame 144 as well as an inner screen frame support 146 hingedly coupled to the main frame 144.

Figure 11:
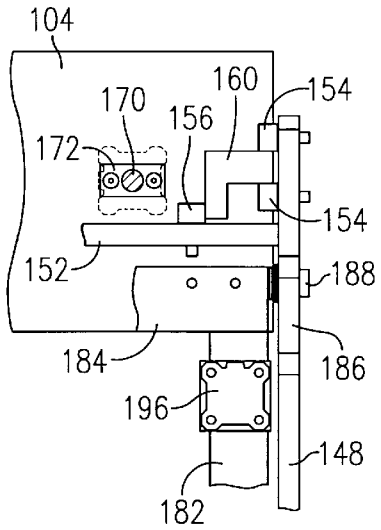
FIG. 11 is a fragmentary top view illustrating a guide unit forming a part of the screen frame support assembly.

The outer main frame 144 has a pair of opposed, spaced apart, upright side members 148 which are interconnected by means of operator and drive side crosspieces 150, 152. The side members 148 include a pair of inwardly projecting, spaced apart rotatable cam followers 154 which are located adjacent the drive side ends thereof as best seen in FIG. 11. In addition, the drive side crosspiece 152 is equipped with a rotatable cam follower 156. The opposite ends of the side members 148 closest the operator side 42 of device 20 each have an outboard wear plate 158. The frame 144 is mounted for up and down vertical reciprocation by means of a pair of somewhat L-shaped, upstanding rear guides 160 affixed to drive side frame plate 104; one leg of each guide 160 is received between the cam followers 154, whereas the other leg thereof is engaged by the follower 156. In addition, the operator side frame plate 102 has a pair of spaced, upstanding projections 162 each supporting a rotatable follower 164, with the followers 164 engaging the wear plates 158.

A pair of rearwardly projecting mounting plates 166 are secured to the opposed ends of the drive side crosspiece 152 and the side members 148. Each plate 166 supports a depending pneumatic piston and cylinder assembly 168 having a piston rod 170; the lower end of each piston rod is secured to a nylon pad 172 affixed to the drive side frame plate 104. The operator side of the main frame 144 has a pair of outwardly projecting support plates 174 secured to the ends of the side members 148. A depending pneumatic piston and cylinder assembly 176 is affixed to each plate 174 and has a lower piston rod 178. The lowermost end of the rod 178 is also received within a nylon pad 180, the latter being secured to the operator side frame plate 102.

The inner screen frame support 146 is made up of a pair of elongated, transversely extending channel elements 182 which are located closely adjacent the side members 148, together with an interconnected drive side crosspiece tube 184 and an interconnected operator side crosspiece tube 185. As best seen in FIGS. 7 and 8, the underside of each channel 182 is notched as at 183 so as to permit appropriate movement of the image-bearing screen within the support 146. The support 146 is pivotally connected to the outer main frame 144 by means of a pair of hinge blocks 186 respectively secured to the upper surface of each side member 148. The hinge blocks each receive an outwardly extending hinge pin 188 which projects from the adjacent end of the tube 184.

The operator side crosspiece tube 185 is equipped with a pair of spaced apart projecting tabs 190 each having a depending abutment screw 192. The screws 192 are adapted to engage the underlying operator side crosspiece 150 when the support 146 is in its closed position. A pair of spaced, pivotal latch members 194 are supported on the crosspiece 150 and are adapted to engage the upper surface of the crosspiece tube 185.

In order to locate and rigidly lock a screen printing frame within the inner screen frame support 146, a total of four pneumatic piston and cylinder assemblies 196 are provided at the corners of the support 146. Specifically, each of the assemblies 196 is supported on the upper flanges of the channel elements 182 adjacent the drive and operator side ends thereof. The assemblies 196 have reciprocal piston rods 198 which, when extended, engage a screen frame located within the channel elements 182, to thereby hold the screen frame firmly in place within the inner screen frame support 146.

Accurate positioning of the outer main frame 144 relative to a web 34 passing through the device 20 is provided by means of a total of four micrometer adjusting screws 200. Each screw 200 includes a depending shaft 202 terminating in a foot 204. As best viewed in FIG. 2, the drive side micrometer screws 200 are supported on the plates 166, with the feet 204 thereof engaging the upper surfaces of the L-shaped rear guides 160. The operator side micrometer screws 200 are affixed to the outer edges of the side members 148 with the feet 204 thereof engaging portions of the machine base assembly 22.

OPERATION

The screen printing device 20 is designed for accurate registration and imprinting of successive images onto segments of a continuous web, such as the webs 34 or 36. A particular feature of the device 20 is the ability to accommodate webs of varying widths, while still maintaining the most desirable true centerline imprinting on the various webs. Furthermore, extremely rapid and accurate registration between successive images is afforded by means of the three motor motive assembly 98.

Figure 12:
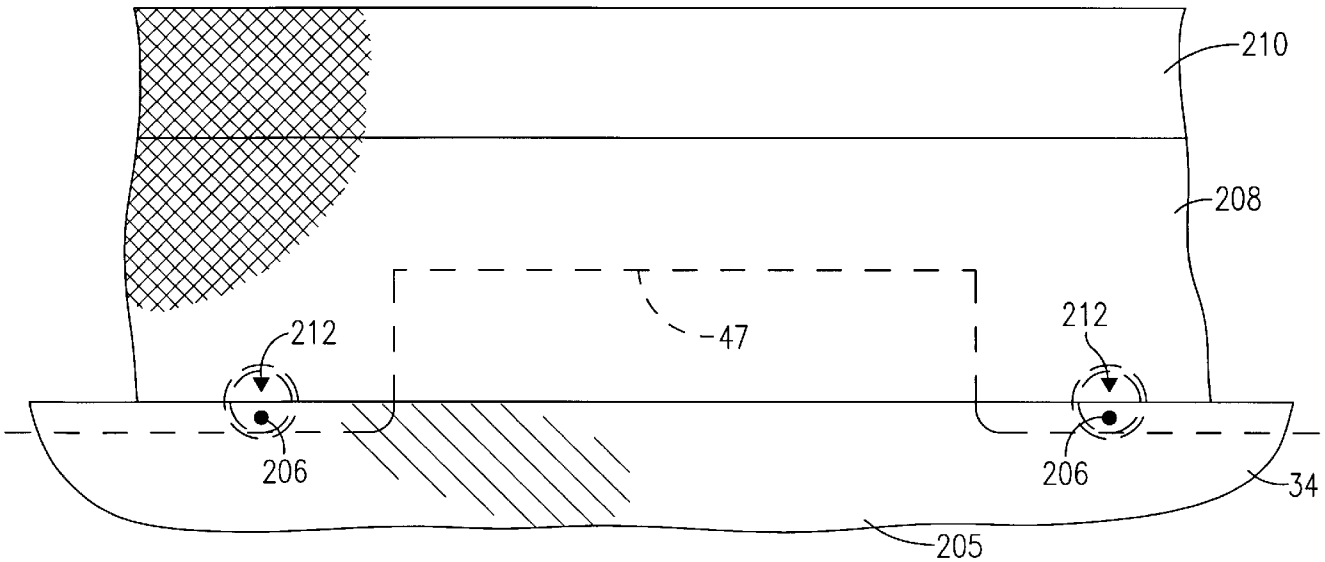
FIG. 12 is a bottom view illustrating the manner in which the camera assembly of the invention is employed for assuring accurate registration between a portion of a web to be imprinted and the screen.

In the following exemplary discussion of the operation of device 20, it will be assumed that segments 205 of a relatively wide, essentially transparent web 34 have previously been imprinted with a desired image. During that initial printing sequence, each segment 205 of the web 34 was also imprinted with a pair of spaced apart fiducials 206 (see FIG. 12) on the web margin. A second screen or stencil 208 bearing the next image to be imprinted in registry with the initial images on the web 34 is also provided, with the screen being supported by a marginal screen frame 210. As best viewed in FIG. 12, the screen 208 is provided with a pair of reference fiducials 212 adjacent its marginal edge.

In the first step, the latches 194 are opened and the inner screen frame support 146 is pivoted upwardly so as to gain access to the operator side ends of the channel elements 182. The screen frame 210 bearing the screen 208 is then installed in the support 146 by sliding the screen frame into the confines of the opposed channel elements 182. The support 146 is then returned to its original position and the latches 194 are employed for holddown purposes. At this point, the pneumatic piston and cylinder assemblies 196 are actuated so that the piston rods 198 thereof engage the upper surfaces of screen frame 210. This serves to firmly hold the screen within the inner screen frame support 146.

If necessary, the platen 24 is shifted along the Y axis so as to properly locate the platen relative to the width of the web 34. Such adjustment involves first relieving the pressure within locking tubes 60 (FIG. 9) and manually moving the platen 24 along the Y axis. The centerline tick 69*a* and the scale markings 69*b* are used in order to accurately position the platen 24 relative to the web width, as will be readily understood from a consideration of FIG. 2. Once the platen is properly positioned along the Y axis, the locking tubes 60 are repressurized, causing a frictional locking engagement between the tubes and the adjacent mating dovetail blocks 64. Again if necessary the operating height of the outer main frame assembly 144 is set by the micrometer screws 200 to permit deflection of the screen 208 and contact thereof on the web segments during screen printing.

Next, the camera assembly 28 is properly positioned relative to the marginal edge of web 34. This involves venting of locking tubes 82 to free the carriage unit 72 followed by rotation of knob 92 so as to move the entire camera assembly 28 along the length of the tubes 88 until the camera lenses have an unimpeded upward view through the platen recesses 47 (FIG. 2). Of course, the cameras 70 can also be moved in the X direction by loosening of the clamp screws 78, shifting the cameras along the length of the tubes 74 and retightening the clamp screws. The respective cameras 70 should be located so that the marginal edge of the web essentially bisects the camera lens, thereby permitting the camera to simultaneously view the fiducials 206 through the transparent web 34 and the reference fiducials 212 on the screen 208. The locking tubes 82 are then repressurized to hold the camera assembly 28 in place.

The device 20 is now ready to receive and imprint the screen image onto segments 205 of the web 34. To this end, the piston and cylinder assemblies 168 and 176 are actuated in order to raise the outer main frame assembly 144, and the web 34 is initially threaded through the device 20 between platen 24 and the screen 208 held within the support 146. A set of web fiducials 206 is then coarsely positioned relative to the screen fiducials 212, the drive mechanism (not shown) for the web 34 is set and engaged, and the frame assembly 144 is lowered.

During high speed screen printing, the web 34 is successively shifted (when the frame assembly 144 is elevated) and stopped at a close but relatively coarse position permitting simultaneous viewing by the cameras 70 of the fiducials 206 of each web segment 205 and the stationary screen fiducials 212. Once each segment 205 is so positioned within the device 20, a vacuum is drawn through platen 24 so as to securely hold the web segment in place, and the frame assembly 144 is lowered.

The X, Y, θ adjusting frame 30 next comes into play to accurately position the outer main frame assembly 144 (and all structure carried thereby including the screen itself) relative to the web segment held by the platen 24. Specifically, the air bearings 138 are actuated by directing pressurized air through the nipples 142, and operation of the three motor motive assembly 98 is initiated so as to move the assembly 184 along the X and Y directions (i.e., parallel with and perpendicular to the path of web travel), and also through a rotational θ direction (i.e., rotation about an axis orthogonal to the web 34). It is a particular feature of the present invention that the three motor motive assembly 98 permits simultaneous X, Y and θ movement of the main frame assembly 144; this assures the most rapid and accurate position of the screen 208 relative to the underlying segment of web 34.

During X, Y, θ adjustment, the cameras 70 are actuated to generate image data, specifically combined images of the adjacent sets of fiducials 206, 212 respectively and the margin of the segment 205 of web 34 and screen 208. This data is delivered to the controller which compares the relative positions of the fiducials 206, 212 and generate appropriate error data representative of the difference between the actual X, Y and θ positions of the fiducials 206 and the desired position thereof relative to the fiducials 212. The position of the X, Y, θ frame 30 is also known via the encoders 116 of each stepper motor 114. The error and position data is then used by the controller to selectively energize the motors 114 to change the position of the frame 30, and thus the image on screen 208, until the latter comes into the desired degree of registration (typically within about 0.001 inches) with the initially imprinted image on the web segment 205.

As described, each of the motor units 108–112 has an eccentric which effectively defines a crank arm for the unit. Thus, there are two types of possible motion associated with each motor unit, namely active rotation of the crank arms and passive translation (sliding) of the individual drive units. In order to achieve translation of the frame 30 along the Y axis transverse to web travel, the crank arms associated with the outboard units 108 and 112 rotate in opposite directions (one clockwise, the other counterclockwise or vice versa), while the central unit 110 slides along the Y axis. X, Y, θ frame rotation (about an axis transverse to the plane of the web segment) is effected by rotating both of the outboard

108 and 112 crank arms in the same direction (clockwise for frame counterclockwise or counterclockwise for frame clockwise) without any translation of the central unit 110. Translation of the frame 30 along the X axis is obtained by rotation of the central unit with both the outboard units sliding fore or aft together. Since the system is nonlinear, for the same amount of frame translation or rotation, the amount of each individual crank arm movement will be different at different crank angles. For the same reason, for translation along the Y axis or frame rotation, the rotation of the outboard crank arms are not necessarily the same amount, but depend upon the crank angles.

Given the foregoing structural arrangement, an appropriate control algorithm can be readily developed and used in the system controller for X, Y, θ adjustment. An analogous algorithm is described in detail in pending application for U.S. patent Ser. No. 08/825,368 filed Mar. 28, 1997 and incorporated by reference herein.

After the operation of the X, Y, θ adjusting frame 30 has been completed, the air bearings 138 are deactivated and a conventional inking squeegee assembly (not shown) associated with the device 20 is actuated to imprint the image carried by screen 208 onto the web segment 205. Preferably, the squeegee stroke is across the web, that is transverse to web travel. Thereupon, the vacuum within platen 24 is relieved, the assemblies 168 and 176 are operated to raise the outer main frame assembly 144 above the web 34, and the web is shifted so as to present the next web segment 205 for printing. The steps of frame lowering, X, Y, θ frame adjustment and imprinting are then repeated.

When it is desired to use a smaller width web 36, the device 20 is accordingly adjusted for true centerline printing thereof. This involves using tick 69*a* to align with the web centerline, and appropriate Y axis of adjustment of the platen 24 and camera assembly 28 as described above and shown in FIG. 3. Thus, the device 20 can accommodate and centerline print webs of widely varying widths.

We claim:

1. A screen printing machine for imprinting a substantially planar segment bearing a locating indicium and comprising:

a platen presenting a segment-engaging face;

a screen-supporting assembly adjacent said segment-engaging face of said platen and adapted to carry a screen;

a camera carried by the platen and oriented for viewing said segment indicium;

a first adjuster for selectively adjusting said screen-supporting assembly in response to the position of said segment indicium as viewed by said camera and in relation to a fixed reference indicium, said first adjuster including structure for selective, simultaneous adjusting movement of said screen-supporting assembly along two transverse adjustment axes parallel to the plane of the segment, and about a rotational axis transverse to said plane; and a second adjuster operationally separate from said first adjuster in order to selectively translate said platen and camera in a direction transverse to the length of said segment whereby the machine may accommodate segments of varying widths.

2. The machine of claim 1, said segment being a part of a continuous web, said machine including structure for successively imprinting a plurality of segments of the web.

3. The machine of claim 1, said screen having said reference indicium thereon, said camera located for viewing said reference indicium simultaneously with said segment indicium.

4. The machine of claim 1, said platen being substantially horizontally disposed, said camera being located beneath said platen.

5. The machine of claim 1, said structure comprising three spaced apart motors operably coupled with said screen-supporting assembly, each of said motors presenting an effective crank arm, and each of said motors being mounted for translatory, sliding movement thereof.

6. The machine of claim 1, said segment-engaging face of said platen having a series of vacuum apertures therethrough for vacuum holddown of said segment.

7. The machine of claim 1, including mechanism for selective adjustment of said camera along perpendicular camera adjustment axes.

8. A method of screen printing comprising the steps of:

providing a substantially planar segment of material to be imprinted having a segment centerline and an indicium thereon;

providing a screen having an image thereon to be imprinted onto said segment in predetermined relationship with said segment indicium;

providing a camera;

placing said segment adjacent said screen in overlying relationship to a platen having a platen centerline;

selectively translating said platen and camera in a direction transverse to said segment centerline as necessary to position the platen centerline in proximal relationship to the segment centerline;

generating an image of said segment indicium using said camera;

adjusting the position of said screen in response to said image and relative to said segment by simultaneously moving said screen along two transverse adjustment axes parallel to the plane of the segment, and about a rotational axis transverse to said plane; and imprinting said image on said segment.

9. The method of claim 8, said segment being a part of a continuous web, said placing step comprising the step of shifting said web to position a segment thereof adjacent said screen.

10. The method of claim 8, said segment and screen being substantially horizontally disposed.

11. The method of claim 8, including the step of placing said camera below said platen.

* * * * *